United States Patent [19]

Ward

[11] 4,297,983

[45] Nov. 3, 1981

[54] SPHERICAL REENTRANT CHAMBER

[76] Inventor: Michael A. V. Ward, 20 Marrett Rd., Lexington, Mass. 02173

[21] Appl. No.: 968,367

[22] Filed: Dec. 11, 1978

[51] Int. Cl.[3] ..... F02P 1/00

[52] U.S. Cl. ..... 123/536; 123/193 P

[58] Field of Search ..... 123/193 P, 193 CH, 193 P, 123/191 A, 119 E, 119 EE, 141, 148 E, 536

[56] References Cited

U.S. PATENT DOCUMENTS

| | | | |
|---|---|---|---|
| 2,402,539 | 6/1946 | Eitel | 123/148 E |
| 2,617,841 | 11/1952 | Linder | 123/148 E |
| 2,876,270 | 3/1959 | Lutz | 123/148 E |

*Primary Examiner*—Ronald H. Lazarus

*Attorney, Agent, or Firm*—Schiller & Pandiscio

[57] ABSTRACT

A technique for improving in an internal combustion engine the coupling of microwave energy to the flame-front of a combusting air-fuel mixture plasma, by shaping the combustion chamber so that the latter accommodates the lowest order "spherical re-entrant" microwave mode (the $TM_{010}^{sr}$ mode). Such a shape contributes to optimum coupling of microwave energy to the flame-front plasma, since this mode (a) minimizes the microwave frequency and hence the flame-front plasma Q and (b) minimizes the variation of Q with flame-front growth.

16 Claims, 9 Drawing Figures

SPHERICAL REENTRANT CHAMBER

Figure 1:
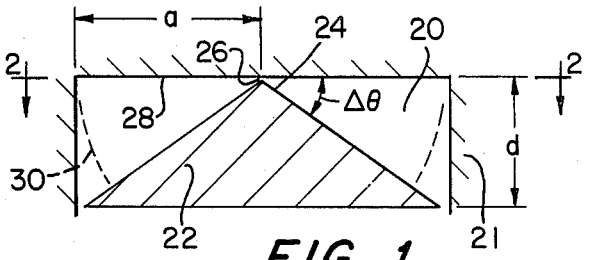

This invention pertains generally to apparatus for and a method of increasing efficiency and/or decreasing exhaust emissions from a combustion chamber such as that of an internal combustion engine. The invention particularly relates to the geometry of the combustion chamber, which generally serves to improve coupling of microwave energy to both stationary and propagating flame-front plasmas existing at the combustion zone of the combustion chamber during combustion.

It is known that the levels of the three principal pollutants (CO, NOx, HC) produced by gasoline powered internal combustion engines tends to decrease as the air-fuel mixture is made progressively leaner (from say 15:1 to 18:1 air-fuel ratio). In theory, efficiency increases as the air-fuel mixture is made slightly lean (from 15:1 to 17:1). In actual practice, because the flame temperature of a lean flame is lower, all the potential gains are usually not realized, since the flame propagates too slowly and is more sensitive to the cooling effects of the combustion chamber walls and intense turbulence (tending to blow out the flame). Although CO and NOx generally are reduced, HC may increase and efficiency will decrease due to incomplete combustion and slow burn.

In order to stimulate the slow burning, cool, lean flame, microwave energy can be coupled to the flame-front electron plasma, heating the electrons, which in turn excite internal energy levels of the flame-front molecules and thus promote their entry into reaction. Teachings of such application of microwave energy to the flame front to stimulate burning are: (1) U.S. Pat. No. 3,934,566, wherein it is shown that the flame-front electron plasma frequency (fp) and the electron-neutral collision frequency ($\nu$) are in the microwave frequency range and thus have the correct properties to allow microwave energy to be coupled to the flame-front plasma; (2) U.S. patent application Ser. No. 622,165 filed Oct. 14, 1977, now abandoned wherein it is shown that use can be made of the metal combustion chamber to improve coupling to the flame front by exciting certain combustion chamber resonant cavity modes; and (3) U.S. Pat. No. 4,138,980, wherein it is shown that for typical IC engine combustion chambers, power levels of the order of 100 watts (microwave power) are sufficient to significantly heat flame-front electrons and improve combustion. All of these documents are incorporated herein in their entirety by reference.

A principal object of the present invention is to provide an improved combustion system employing microwave enhanced combustion wherein coupling of the microwave energy to the flame-front plasma is optimized.

Yet another object of the present invention is to provide such an improved system wherein the geometry of the combustion chamber, and the input microwave frequency are established to provide a low order resonant mode which minimizes the variation of Q with flame-front growth.

Yet other objects of the present invention are to provide novel coupler means for introducing microwave energy into a combustion chamber, and microwave choke means for improving the Q of certain combustion chambers.

The invention features a novel cylindrical combustion chamber (designated as the spherically re-entrant cavity chamber) the principal feature of which is that the piston-to-cylinder head gap is small near the center and increases as one moves radially outward for at least about two-thirds of the combustion chamber radius. The chamber can be excited (with microwaves) by a short probe extending slightly beyond a centrally located coaxial coupler (which can also be used for ignition). The two principal features of this cavity chamber are that it resonates at the lowest possible frequency (giving the lowest flame-plasma loaded Q value) and it yields an approximately constant flame-plasma loaded Q for about the first half of the travel of the flame front (initial flame front). It will be appreciated from the following description, that the novel chamber of the present invention while detailed principally in connection with a piston-type internal combustion engine in which the chamber volume can be deemed quasi-static in that it does not materially change prior to near-completion of combustion, the chamber is very useful in other contexts in which the chamber volume is either quasi-static or truly static.

In another aspect, the invention features novel couplers for both producing ignition and applying microwaves to enhance combustion reactions.

Other objects of the invention will in part be obvious and will in part appear hereinafter. The invention accordingly comprises the process involving the several steps and the relation and order of one or more of such steps with respect to each of the others, and the apparatus possessing the construction, combination of elements, and arrangement of parts, all of which are exemplified in the following detailed disclosures, and the scope of the application of which will be indicated in the claims.

Figure 2:
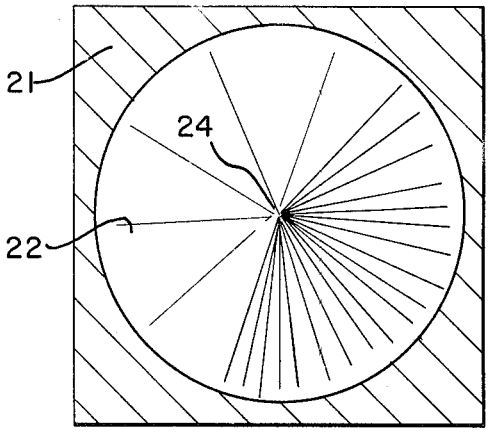
Figure 9:
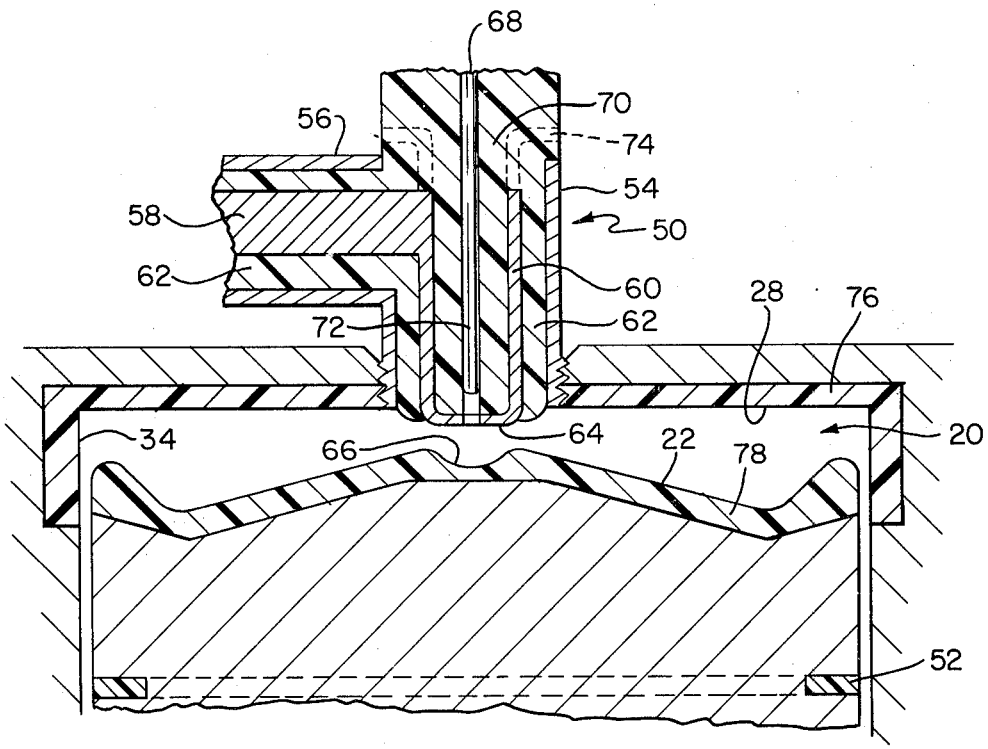
Figure 3:
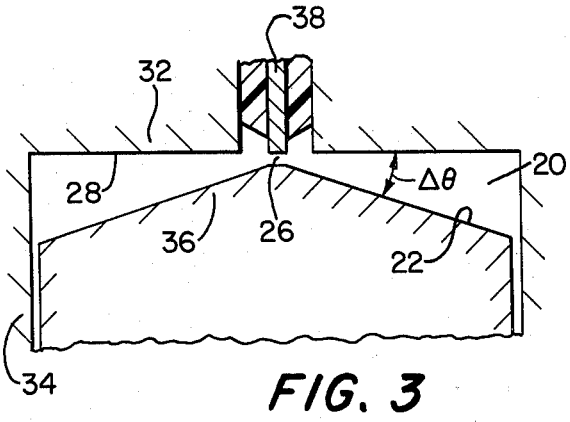

For a fuller understanding of the nature and objects of the present invention, reference should be had to the following detailed description taken in connection with the accompanying drawings wherein FIG. 1 is a schematic cross-section through an idealized form of spherical re-entrant combustion chamber;

FIG. 2 is a section of FIG. 1 taken along the line 2—2;

FIGS. 3 through 8 are schematic cross-sections of combustion chambers shaped according to the principles of the present invention varying in resonant frequency from one another; and FIG. 9 is an idealized cross-section through a combustion chamber of the present invention showing a unitary coupler and igniter wherein the ignition high voltage and microwave energy are isolated from one another, the chamber also incorporating a novel choke.

In accordance with the present invention, in order to improve coupling of microwave energy to a flame-front plasma in a metallic combustion chamber, and particularly in a piston-type engine, the shape of the combustion chamber is established (by shaping either the piston face or the cylinder head, or both) so that the chamber (1) accommodates a microwave resonant mode with lowest possible microwave frequency and (2) the mode provides a large electric field in the region of the initial burn, i.e. the region around the center of the cylinder for the most practical case. The region of time of initial burn is defined as that corresponding to the flame front traveling half-way radially across the chamber from the center). The reasons for this are based on the understanding of the expression for the Q of an engine cylinder resonantly excited by microwaves and electrically loaded by the flame plasma, where Q is defined as:

$$Q=(2\pi fA)/L \quad (1)$$

where

A is the time average energy stored in system,

L is the energy loss per second in system, and f is the operating microwave frequency.

Q will be subscripted "p" and "c" to correspond respectively to the Q value of the cavity loaded with the flame plasma and with perfectly electrically conducting walls ($Q_p$), and the Q value of the unloaded cavity with lossy walls ($Q_c$).

The general expression for $Q_p$ is given by Ward, M. A. V., Wu, T. T. (1978), "A Theoretical Study of the Microwave Heating of a Cylindrical Shell, Flame-Front Electron Plasma in an Internal Combustion Engine", COMBUSTION AND FLAME, Vol. 1, 32 (1), p. 57–71. In that paper, the $Q_p$ value for a cylindrical flame front is calculated. The $Q_p$ value for a spherical flame front is given in Ward, M. A. V. (1978), "Potential Uses of Microwaves to Increase IC Engine Efficiency and Reduce Exhaust Pollutants", THE JOURNAL OF MICROWAVE POWER, 12(3), pp. 187–199.

For the present purposes, since the flame-front plasma thickness is small relative to the variation in the electric field, one can define, based on the above-mentioned 1978 papers, $$Q_p = \frac{\omega\nu}{(\omega_p)^2} \quad \frac{K}{|E_x|^2 \Delta V_x} \quad (2)$$

where $\omega=2\pi$ times the microwave frequency f $\omega_p=2\pi$ times the electron plasma frequency $f_p$ $\nu$=electron-neutral collision frequency, $E_x$=electric field strength at location x in the chamber, $\Delta V_x$=the volume of the flame front plasma at location x, and K=constant.

From experiments carried out both in single-cylinder engines and in combustion bombs (fixed volume combustion chambers) and from the expressions above derived from the aforementioned Ward-Wu (1978) paper relating level of electron heating to $Q_p$, it is desirable that $Q_p$ lie in the range $$20 \leqq Q_p \leqq 200 \quad (3)$$

Reasons for this are discussed in the Ward (1978) paper. For the present purposes, it should be recognized that for the microwave modes of interest, typical engine cylinders (without the flame) have Q's ($Q_c$) in the range:

$$100 \leqq Q_c \leqq 300 \quad (4)$$

Since the percent of microwave energy absorbed by the flame (as opposed to the cylinder) is given by:

$$(Q_c/Q_c+Q_p)\times 100\% = (Q/Q_p)\times 100\% \quad (5)$$

where $1/Q=1/Q_c+1/Q_p$, Q being the Q of the cavity loaded by the flame plasma and wall resistance. It is clear that it is necessary that $$Q_p \leqq Q_c \text{ or } Q_p \leqq 2Q \quad (6)$$

in order that at least half of the microwave energy be absorbed by the flame plasma. Laminar flame tests carried out in combustion bombs of 3" diameter, and one inch height, excited in the cylindrical $TM_{010}$ mode have shown the minimum Q to be about 600. Although the $Q_p$ in the actual engine cylinders will be lower (because of lower piston-to-cylinder height and larger flame front), the minimum value of 600 is nonetheless somewhat on the high side.

For a given chamber diameter the $Q_p$ could be lowered by lowering the angular frequency $\omega$ for fixed diameter. The $TM_{010}$ mode has a frequency governed by:

$$k_o a = 2.40 \quad (7)$$

where a=radius of combustion chamber $k_o=\omega/c$ c=velocity of light so that:

$$f=(2.4/2\pi)\cdot(c/a) \quad (8)$$

Referring now to FIGS. 1 and 2 there is shown in cross-section a cavity 20 in a block 21, the cavity being deemed "spherically re-entrant" in that the cavity is generally a spherical section which additionally contains at least one cone 22 extending into the cavity with the apex 24 of the cone lying approximately adjacent the spherical center of the cavity, the conical axis being colinear with a spherical radius. This idealized cavity configuration, as will be shown, defines generally the geometry of a combustion chamber which provides optimum coupling of microwave energy to the flame front plasma.

The diameter of the chamber is denoted "a" and the maximum height of the conical portion "d". A gap 26 is provided between the apex of the cone and the electrically conductive upper surface 28 of the chamber. The included angle between surface 28 and the surface of cone 22 is shown as "$\Delta\theta$". Of course, the inward wall perturbation provided by the apex of cone 22 at a point of high electric field is the center of the chamber.

In providing the cavity of FIG. 1, the electric field has been deformed such that it is very high near the center. Again, intuitively, if the electric field is written as:

$$E(\rho) \propto \frac{V(\rho)}{(d-h)} = \frac{\overline{V}(\rho)}{\rho} \quad (9)$$

where $\rho$ is a radial vector from the spherical center, h is the height of the conical portion at position $\rho$, and $V(\rho)$ is the voltage across gap 26 (proportional to the field of an unperturbed cavity), as $\rho$ approaches zero, $E(\rho)$ becomes very large, which is precisely the behavior sought. In fact, $E(\rho)$ is singular at $\rho=0$. From the mathematical point of view, since the initial flame front grows at a rate proportional to its displacement squared, i.e.

$$\Delta V(x)=\Delta V(\rho) \propto K_1\rho^2 \quad (10)$$

where $K_1$ is a constant independent of $\rho$ then:

$$Q_p \propto \frac{1}{E^2(\rho)\,\rho^2} \quad (11)$$

For all other known modes, $E(\rho)$ is well behaved and finite at $\rho=0$. For example, the cylindrical $TM_{010}$ mode has:

$$E(\rho)=AJ_o(k_o\rho)\overline{\overline{\rho\to 0}}A \quad (12)$$

where $J_o(k_o\rho)$ is the zero order Bessel function. Substituting in equation (11) above:

$$Q_p \propto \frac{1}{A^2J_o^2(k_o\rho)\,\rho^2} \quad (13)$$

and the $Q_p$ is very large for $\rho$ small, an undesirable feature for real world engines (with $Q_c$ of about 100–300).

However, if one substitutes the singular mode $E(\rho)=V(\rho)/\rho$ in the same expression, one obtains:

$$Q_p \propto \frac{1}{\overline{V^2}(\rho)\frac{1}{\rho^2}\cdot\rho^2} = \frac{1}{\overline{V^2}(\rho)} \quad (14)$$

i.e., the $\rho^2$ behavior is precisely cancelled and we have the lowest possible $Q_p$ for the initial flame front.

The mode that has been developed is in fact a variant of a spherical cavity mode. This spherical segment mode (lowest order one) has field components:

$$E_\theta(r,\theta) = \frac{A}{\sin\theta}\,\zeta_o\frac{\cos k_o r}{k_o r} \quad (15)$$

$$H_\phi(r,\theta) = \frac{-A}{\sin\theta}\,\frac{\sin k_o r}{k_o r} \quad (16)$$

$$\zeta_o\sqrt{\mu_o/\epsilon_o} \quad (17)$$

$=120\pi$ ohms, the impedance of free space, $\mu_o,\epsilon_o$ being respectively the permeability and dielectric constant of free space, Since $E_\theta$ is normal to the surface $\theta=\pi/2$, the upper surface 28 of the spherical segment can be configured as a planar conductor. Recognizing that engine cylinders have large diameter (2a) to height (d) ratios (2a/d), FIG. 1 is drawn with a small included angle $\Delta\theta$. Note that in FIG. 1 $\theta\simeq z$ (the $\theta$ direction is almost vertical) which implies that (changing spatial coordinates) $E_\theta$ can be replaced by $E_z$, r by $\rho$, and sin $\theta$ by 1. Designating this mode as $TM_{010}^{sr}$ (the superscript "sr" meaning "spherical re-entrant") we can write for the $TM_{010}^{sr}$ mode:

$$\vec{E} = \hat{z}E_z = \hat{z}A\zeta_o\frac{\cos k_o\rho}{k_o\rho} \quad (18)$$

$$\vec{H} = \hat{\phi}H\phi = -\hat{\phi}A\frac{\sin k_o\rho}{k_o\rho} \quad (19)$$

with resonant frequency defined by:

$\cos k_o a=0$ $k_o a=\pi/2$ where A is the amplitude factor i.e. a constant. If one removes the spherical region designated as "skirt" in FIG. 1 (shown in dotted lines at 30) which represents an outwards perturbation at a point of high magnetic field, and replaces the "skirt" with a cylindrical wall as would be the case with a real internal combustion engine cylinder, a further lowering of resonant frequency will result.

In the practical situation, the minimum radial displacement $r_{min}$ is some finite value so that $E_\theta(r,\theta)$ and hence $E_z(\rho)$ are not singular. If one takes FIG. 4 as a representative combustion chamber, then the electric field is given by:

$$E_z(\rho)=E_oJ_o(k_o\rho) \text{ for } \rho\leqq\Delta a \quad (20)$$

$$E_z(\rho) = (k_o\Delta a)E_o\frac{\cos k_o\rho}{k_o\rho} + \tfrac{1}{2}(k_o\Delta a)^2E_o\frac{\sin k_o\rho}{k_o\rho} \text{ for } |\Delta a| \leqq \rho \leqq a \quad (21)$$

where Eo is the maximum electric field and the resonant frequency is given by:

$$f=f_o/(1-\tfrac{1}{2}(\Delta a/d) \text{ where } f_o=\tfrac{1}{4}\text{ (speed of light/a)}$$

and we have tacitly assumed that $$\tfrac{1}{2}(k_o\Delta a)^2<<1$$

or $$\tfrac{1}{2}(k_o\Delta a)^2\lesssim 1$$

In summary, assuming ignition at the center, an ideal engine cylinder cavity (from the microwave point of view) is provided by moving the center points i.e. regions of initial flame front towards each other, thereby lowering resonant frequency and $Q_p$ of the initial flame-front plasma loaded cavity. The electromagnetic mode excited is thus one in which the electric field strength is greatest at the region of the initial flame or less stable flame zone, and falls off to lower values at the regions where the more fully developed flame occurs. In fact, using the spherical re-entrant cavity as the model, one obtains:

$$f=\tfrac{1}{4}\cdot c/a \quad (22)$$

$$Q_p = \frac{\omega v}{\omega_p^2}\,\frac{a}{\delta}\,\frac{1}{2\cos^2 k_o\rho} \quad (23)$$

where $\delta$=flame plasma thickness Compare this with Ward (1977) and one sees that unlike the cylindrical cavity case where the $Q_p$ changes by about two orders of magnitude during the initial burn before reaching the minimum value, $Q_p$ in the present invention is approximately constant and equal to the minimum value during initial burn. Excitation of the spherical reentrant mode is achieved by a probe such as that shown in U.S. Pat. No. 3,934,566, the probe being located preferably at or near the axial center of the chamber at the cylinder head. Methods of coupling both the DC and microwave by such a probe are described in U.S. Pat No. 3,934,566.

Tests carried out on a 3" diameter chamber with propane at stoichiometric air-fuel ratio and one atmosphere have shown $Q_p$ values reasonably constant throughout the initial burn (one of the requirements). They have also shown the value lowered to the range 200 to 300 (at f=2.70 GHz) throughout most of the initial burn for a combustion chamber similar to FIG. 8.

The desirable reduction in $Q_p$ value is larger than based on the frequency reduction and is in small part due to the smaller combustion chamber volume (over the cylindrical case) and in part due to better coupling of the microwave energy to the flame plasma (the flame front and electric field are more parallel leading to improved coupling, as can be seen from Ward (1978)). The spherical re-entrant cavity combustion chamber is ideally suited for strong coupling between the microwave energy and the flame plasma during initial burn, and is expected to lower $Q_p$ values to about 100 when used in an optimum configuration (such as that of FIG. 9).

There is one additional advantage and one disadvantage to utilizing the spherical re-entrant cavity. The advantage is that constancy of Q (during the important time of initial burn) implies constant impedance (at the resonant frequency) of the plasma loaded cavity and therefore better match between microwave generator and plasma. The disadvantage is that movement of the piston near top dead center will produce a larger shift in resonant frequency than in the cylindrical cavity case. But this latter problem can be overcome by electronically shifting the frequency slightly, synchronously with the piston motion so that the microwave generator is at resonance at all times, or by sensing the reflected signal and appropriately shifting the frequency.

Various modifications of combustion chambers, all having the two required features (lower frequency and approximately constant Q during initial burn) are shown in cross-section in FIGS. 3 to 8 inclusive. The value of resonant frequency increases as the Fig. number increases, i.e., f resonant of the embodiment of FIG. 4>f resonant of the embodiment of FIG. 5>f resonant of embodiment of FIG. 6 and so on. At the same time, the shift in resonant frequency with piston motion decreases (as one proceeds from FIGS. 3 to 8).

Figure 4:
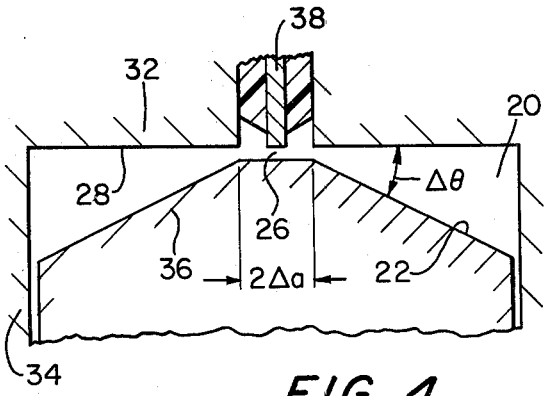
Figure 5:
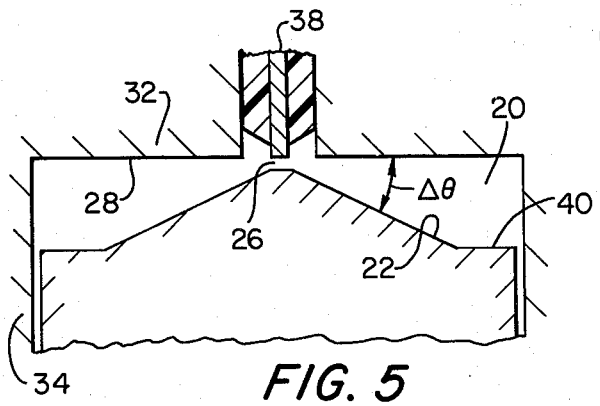
Figure 6:
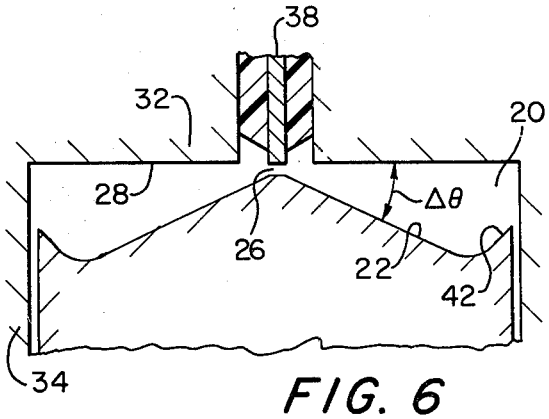
Figure 7:
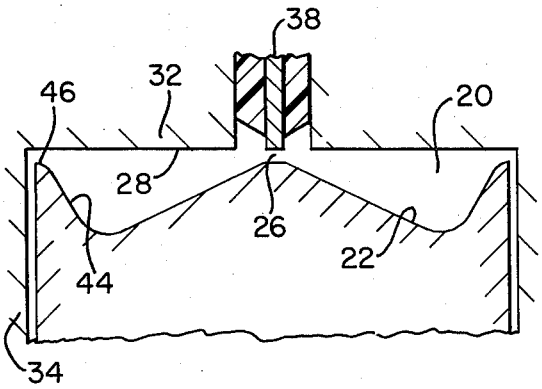
Figure 8:
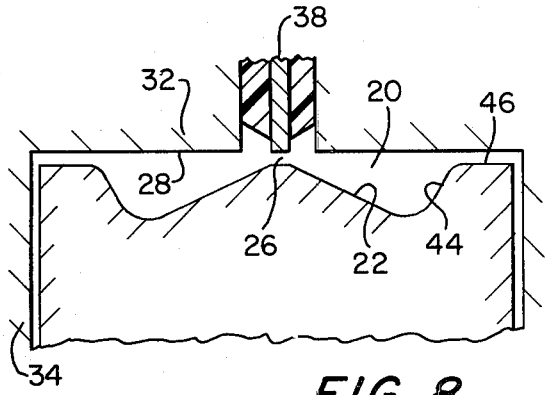

In each of FIGS. 3 to 8 inclusive there is shown spherical re-entrant cavity 20 corresponding to the combustion chamber of a conventional piston-type IC engine and defined by cylinder head 32, cylinder walls 34 and piston 36. Mounted in cylinder head 32 and communicating with chamber 20 is coaxial probe coupler 38 to excite the cavity with microwaves. The ignition spark may also be formed at the couplers adjacent gap 26. Microwave energy is fed down the coaxial coupler 38 and gap 26 is adjusted to give optimum match for the piston at TDC. FIG. 4 shows substantially the same configuration as the embodiment of FIG. 3 in that in both, the cylinder head surface 28 is flat and top of piston 36 is shaped as cone 22, but the included angle $\Delta\theta$ in FIG. 4 is somewhat larger than in FIG. 3. In the embodiment of FIG. 5 although $\Delta\theta$ is about the same as in FIG. 4, the top of piston 36 is conically shaped but of smaller maximum diameter than the piston of FIG. 4 and is surrounded by a substantially flat annulus 40 approximately parallel to surface 28. The embodiment of FIG. 6 differs from that of FIG. 5 only in that annulus 42 surrounding cone 22 of piston 36 forms a more acute angle to the conical surface and in effect is a conical section inverted with respect to cone 22. In FIG. 7, $\Delta\theta$ is also formed as a central cone 22 surrounded by an inverted conical section or annulus 44 which in turn is surrounded by a narrow flat annular edge 46 parallel to cylinder head surface 28. FIG. 8 is quite similar to FIG. 7 but the radial width of annular edge 46 is larger.

Of the variations of combustion chambers corresponding to the spherical re-entrant cavity case shown in FIGS. 3 to 8, the most practical of these are FIGS. 6, 7 and 8. Which particular shape is most practical is governed by the specific features of the particular system under study, such as the type of microwave source used (voltage tunable or not), the minimum value of Q, the value of $Q_c$ and $Q_p$, the manner in which the mixture is ignited, and other factors.

A feature unique to the spherical re-entrant mode is the very large electric field near the tip of the microwave coupler. Because of this, a single microwave source may be used to both ignite and enhance combustion reactions.

One can write for a spherical re-entrant combustion chamber with gap $\epsilon$:

$$E(\epsilon) = E_o \frac{\cos k_o\epsilon}{k_o\epsilon} = \frac{2}{\pi} E_o \cdot \frac{a}{\epsilon} \text{ volts/cm} \tag{24}$$

where

E ($\epsilon$) ~ electric field in gap $\epsilon$ $$E_o = 10\sqrt{PQ_c} \text{ volts/cm} \tag{25}$$

(See Ward (1977) for $E_o$).

If $P=300$ $Q_c=300$ $E(\epsilon)=6\pi \cdot a/\epsilon$ kilovolts/cm

If $a \simeq 5$ cms, $E(\epsilon) \simeq 10/\epsilon$ kilovolts/cm For a gap of 0.1 cm (0.040"), the voltage across the gap $V(\epsilon)$ will be $V(\epsilon)=E(\epsilon)\epsilon=10$ kilovolts which is of the order of voltage required to produce breakdown up to a pressure of three to four atmospheres.

An interesting variant of the probe coupler (for both DC and microwave) is to use a three-conductor coupler, with the conventional high voltage carried by the center conductor while the microwave is carried between the second and third conductor as shown in FIG. 9. In this case, with the second "hot microwave" wire DC grounded (as in a magnetron—see Ward U.S. Pat. No. 3,934,566), the arc forms between the first and second conductor and the microwave and high voltage DC are automatically isolated. Note that the DC ignition resembles the Coaxial Spark Igniter of Dale, J. D., and Smy, P. R., (1978), COMBUSTION AND FLAME 31, p. 173 to 185. In terms of the present system, the arc kernel is blown out in the form of a dense plasma from which develops the initial flame-front kernel which grows outwards being fed by the high electric field lines of the microwave energy. The following features should be appreciated.

(1) Since the center conductor is at or below the level of the second conductor, little or no microwave can be coupled down the high voltage (transmission) line. (2) Even if the microwave generator is off resonance, high fields will exist at the junction (referred to as the non-resonant component in Ward U.S. Pat. No. 3,934,566) to be coupled to the initial flame front. (3) The microwave generator does not "see" the short-circuiting breakdown arc of the conventional high voltage and is thus not detuned, pulled, or otherwise affected. As can be seen from FIG. 9, at most the microwave energy couples to the outermost region of the ignition plasma, which is the most important region in terms of causing ignition.

Returning to the requirement that $Q_p \leqq Q_c$ for at least half of the microwave power to be absorbed by the flame plasma, it is clear that if the requirement is not met because the combustion chamber $Q_c$ is too low, then corrective measures should be taken. Since low $Q_c$ values (low being designated as $Q_c<100$) cannot result from the finite conductivity of the metal wall (wall losses), even for relatively poor electrical conductive materials as some stainless steels, the low Q will result from the microwave leakage through the cylinder head gasket and piston walls in the conventional IC engine. The head gasket leakage can be eliminated by use of a metallic gasket which may or may not have a microwave grooved choke incorporated (such chokes are well known to microwave engineers). Piston wall leakage which occurs especially in the cylindrical $TM_{010}$ and $TM_{010}^{sr}$ modes (maximum currents on the cylinder-piston walls), requires that a choke be incorporated either on the cylinder wall or piston wall so that a large mismatch in impedance occurs looking into the piston-oil film-cylinder wall transmission line (the piston may be envisioned as a grossly oversized center conductor of a transmission line with the cylinder walls as outer conductor and the two separated by the engine oil film that exists between them). In particular, one requires that the piston face edge-cylinder wall junction at TDC (designated as "junction") look like a short circuit (the current must cross the junction to achieve current flow on the piston surface). This can occur by creating a short circuit at multiples of half wavelengths from the junction down the piston-cylinder wall transmission line. This is done by moving one quarter (or n/4 where n is an odd integer) wavelength down the "junction" and then placing an annular choke in a quarter wavelength slot either in the piston skirt or the cylinder wall. The end of the slot looks like a short circuit, when when transformed back one half wavelength to the junction, makes the junction look like a short. It should be recognized that the wavelength along the oil film ($\lambda_1$) and in the slot ($\lambda_2$) are related to the free space wavelength $\lambda_o$, where $\lambda = c/f$ (c=speed of light, f=resonant frequency of cavity), according to:

$$\lambda_1 = \lambda_o/\sqrt{\epsilon_1};\ \lambda_2 = \lambda_o/\sqrt{\epsilon_2} \tag{26}$$

where $\epsilon_1$ and $\epsilon_2$ are the relative dielectric constants of the oil and of the material filling the slot, respectively.

FIG. 9 is a detailed drawing of a conventional single cylinder engine at TDC incorporating a form of the spherical reentrant combustion chamber 20 defined by a flat cylinder head surface 28, cylinder walls 34 and conically shaped piston face 22. The engine incorporates a special microwave-spark coupler 50 whose principle feature is that the high voltage (HV) ignition is isolated from the microwave system. In addition, the piston incorporates annular 52 choke for reducing microwave leakage past the piston as above described. The microwave transmission line is a coaxial line made up of outer cylindrical electrical conductor 54 coupled to cylindrical conductor 56 and the inner electrical conductor 58 coupled to cylindrical electrical conductor 60 which lies coaxially inside conductor 54, all separated by insulating material or dielectric 62. Microwave energy introduced across conductor 58 and 56 is carried by dielectric 62 where it is coupled into chamber 20 by portion 64, the bottom end of conductor 60, which protrudes beyond the cylinder head surface 28 is in close proximity of the center 66 of piston face 22. It should be recognized that microwave tuning of the chamber occurs through vertical displacements of 64. The high voltage for ignition is carried down the center conductor 68 which is separated from conductor 60 by dielectric 70 and a spark is formed between bottom tip 72 of conductor 68 and the closest part of portion 64 of conductor 60. The dimensions of the cavity formed by spacing and disposition of tip 72 and portion 64 determine the properties of the spark kernel; piston center 66 may be cup-shaped to accommodate the spark plasma that is blown out of the cavity. It should be appreciated that conductors 58 and 60, the "electrically hot" side of the microwave line, behave as a ground for the high voltage carried on conductor 68 since typically microwave energy is coupled from a magnetron by loop coupling (resulting in DC grounding of the center conductor to the grounded anode of the magnetron). Since tip 72 of conductor 68 is above the microwave coupling probe, little microwave energy is coupled down the HV transmission line made up of conductors 60 and 68 and dielectric 70. Note that inner microwave conductor 60 can be grounded at a point 74 (shown in broken line) where the microwave charge has a minimum or the current is maximum. This prevents microwave leakage up the ignition wires. By making point 74 variable, it can act as a tuning stub to improve the match between the microwave generator and chamber 20.

The combustion chamber design can be further improved by coating the chamber surfaces with ceramic as shown as layer 76 along cylinder surface 28 and adjacent cylinder walls and layer 78 on piston surface 22. This has several desirable effects.

(1) It lowers the resonant frequency and provides a higher $Q_c$ because of the increased "electrical" chamber volume (as defined by the metal surfaces).

(2) It further lowers resonant frequency because of the dielectric properties of the ceramic, which decreases the wavelength in the ceramic by $\lambda_o/\sqrt{\epsilon_r}$, where $\lambda_o$=free space wavelength $\epsilon_r$=dielectric constant of ceramic.

(3) Because of the initially larger electrical volume, the resonant frequency will be more stable relative to small displacements of the piston.

(4) The ceramic layer at the cylinder wall allows non-zero electric fields to exist parallel to the wall for stimulation of combustion at the side-wall quench layer and hence reduction of levels of unburnt hydrocarbons.

Finally, it should be appreciated that should the operating frequency be unduly lowered by the ceramic so that $\omega << \omega_p^2/\nu$, then the next higher mode of the $TM_{ono}^{sr}$, i.e. the $TM_{020}^{sr}$ mode can be excited.

Since certain changes may be made in the above apparatus and method without departing from the scope of the invention herein involved, it is intended that all matter contained in the above description or shown in the accompanying drawing shall be interpreted in an illustrative and not in a limiting sense.

What is claimed is:

1. In a combustion system including a combustion chamber having a cylindrical configuration, including opposite end walls means for introducing a combustible mixture into said chamber, means for igniting said mixture, moveable means for compressing the mixture and means for conducting to said chamber electromagnetic energy at a microwave frequency, the improvement wherein said frequency and the configuration of said chamber are selected such that a cylindrical resonant cavity mode is substantially continuously excited in said chamber by said energy during combustion of said mixture, said mode being one wherein the electric field strength is largest in the region of the initial flame zone and falls off to lower strength in the region of fully developed flame. and one of said end walls includes a non flat surface so that the shift of the resonant frequency at which combustion occurs, with movement of the movable means, is reduced.

2. A system as defined in claim 1 wherein said chamber is a spherical reentrant chamber.

3. A system as defined in claim 5 wherein the other of said end walls is a substantially flat circular surface transverse to the cylindrical axis of said chamber, said flat surface having a central aperture in which said means for ignition is disposed, and said one end wall includes a conical surface coaxially disposed about said cylindrical axis with the apex of said conical surface directed toward said central aperture.

4. A system as defined in claim 3 wherein the apex of said conical surface is cupped.

5. A system as defined in claim 3 wherein said conical surface is surrounded by a coaxial annular surface substantially parallel to said flat surface.

6. A system as defined in claim 3 wherein said conical surface is surrounded by a coaxial inverse conical surface.

7. A system as defined in claim 3 wherein said conical surface is surrounded by a conical inverse conical surface and the latter in turn is surrounded by a coaxial annular surface substantially parallel to said flat surface.

8. A system as defined in claim 3 wherein said flat surface is the interior top surface of said cylindrical configuration, said movable means comprising a piston disposed for movement within said cylindrical configuration, said conical surface constituting the upper surface of said piston.

9. A system as defined in claim 1 wherein said mode is of the type $TM_{010}^{sr}$.

10. A system as defined in claim 4 wherein said movable means comprises a piston mounted for movement in said chamber and said system further includes microwave choke means disposed coaxially and substantially annularly with respect to the junction of said piston and the cylindrical wall of said chamber.

11. A system as defined in claim 10 wherein said choke means is positioned substantially a distance, $n\lambda/4$, from the junction of the edge of said piston and said wall at TDC of said piston, n being an odd integer, and $\lambda$ being the resonant wavelength of said mode.

12. A system as defined in claim 11 wherein said piston includes an annular slot in the piston skirt, and said choke means is mounted in said slot.

13. A system as defined in claim 1 including a ceramic coating disposed on the interior walls of said chamber.

14. A system as defined in claim 1 including a unitary means for coupling said electromagnetic energy to said chamber and a high voltage for igniting said mixture, said unitary means including a first central conductor connectable at one end to a source of ignition voltage, the other end of said conductor being disposed to communicate with said chamber;

a first cylindrical conductor coaxially surrounding said central conductor and spaced therefrom by a dielectric, one end of said first cylindrical conductor communicating with said chamber annularly about said central conductor; and a second cylindrical conductor coaxially surrounding said first cylindrical conductor and spaced therefrom by a dielectric, said first and second cylindrical conductors being connectable to a source of microwave energy for transmitting the latter into said chamber.

15. A combustion system including a combustion chamber defined by an engine cylinder and the top surface of a piston disposed for movement within said engine cylinder so as to vary the size of said chamber during combustion, means for introducing a combustible mixture into said chamber, and means for introducing into said chamber electromagnetic energy at a microwave frequency, the improvement wherein said frequency and the configuration of said chamber are selected such that a cylindrical resonant cavity mode is substantially continuously excited in said chamber by said energy during combustion of said mixture, said piston having a non-flat top surface shaped so that the shift with piston motion of the resonant frequency at which combustion occurs is reduced.

16. A system according to claim 15, wherein said non-flat top surface portion includes a conical surface coaxially disposed about the cylindrical axis of said chamber.

* * * * *

UNITED STATES PATENT AND TRADEMARK OFFICE

CERTIFICATE OF CORRECTION

PATENT NO. : 4,297,983

DATED : November 3, 1981

INVENTOR(S) : Michael A. V. Ward

It is certified that error appears in the above-identified patent and that said Letters Patent are hereby corrected as shown below:

Claim 1, column 10, line 49, insert a comma (,) after the word "walls".

Claim 1, column 10, line 61, delete the period (.) after the word "flame".

Claim 16, column 12, line 41, after "surface" (first occurrence) delete "portion".

Claim 16, column 12, line 41, after "surface" (second occurrence) insert "portion".

Signed and Sealed this

*Thirteenth* Day of *April 1982*

|SEAL|

*Attest:*

GERALD J. MOSSINGHOFF

*Attesting Officer*

*Commissioner of Patents and Trademarks*